United States Patent [19]

Ishimoto

[11] Patent Number: 4,854,909

[45] Date of Patent: Aug. 8, 1989

[54] APPARATUS FOR TRANSFERRING A RUNNING TRACK OF A RACING TOY

[75] Inventor: Zenichi Ishimoto, Tokyo, Japan

[73] Assignee: Nikko Co., Ltd., Tokyo, Japan

[21] Appl. No.: 68,226

[22] Filed: Jun. 30, 1987

[30] Foreign Application Priority Data

Jul. 9, 1986 [JP] Japan ..... 61-159824

[51] Int. Cl.[4] ..... A63H 17/39; A63H 33/26; B61F 11/00

[52] U.S. Cl. ..... 446/129; 446/456; 446/460; 104/261; 104/305

[58] Field of Search ..... 446/129, 444, 445, 446, 446/454, 455, 456, 457, 460, 465, 468; 273/86 B; 104/242, 261, 304, 305

[56] References Cited

U.S. PATENT DOCUMENTS

| | | | |
|---|---|---|---|
| 3,239,963 | 3/1966 | Smith et al. | 104/305 X |
| 4,163,341 | 8/1979 | Jones et al. | 446/468 X |
| 4,221,077 | 9/1980 | Von Winckelmann | 446/460 X |
| 4,411,100 | 10/1983 | Suimon | 446/460 |
| 4,453,712 | 6/1984 | Lee | 273/86 B |
| 4,471,566 | 9/1984 | Ishimoto | 446/460 X |
| 4,479,650 | 10/1984 | Neuhierl | 104/304 X |
| 4,571,213 | 2/1986 | Ishimoto | 446/129 X |
| 4,741,418 | 5/1988 | Kaiser | 446/465 X |
| 4,743,214 | 5/1988 | Tai-Cheng | 446/129 |
| 4,764,150 | 8/1988 | Uchino | 446/460 X |

FOREIGN PATENT DOCUMENTS

| | | | |
|---|---|---|---|
| 24240 | 2/1981 | European Pat. Off. | 446/460 |
| 2135095 | 1/1973 | Fed. Rep. of Germany . | |
| 2605578 | 11/1976 | Fed. Rep. of Germany | 446/460 |
| 3003707 | 8/1981 | Fed. Rep. of Germany | 273/86 B |
| 1581242 | 12/1980 | United Kingdom | 446/456 |

*Primary Examiner*—Robert A. Hafer
*Assistant Examiner*—Charles H. Harris
*Attorney, Agent, or Firm*—Young & Thompson

[57] ABSTRACT

An apparatus for transferring a running track of a toy car racer in a racing toy is disclosed, in which a motor-driven running body runs on a base having a plurality of guide tracks in parallel spaced apart from each other and is provided with a guide element engageable with the guide track, an electromagnetic coil for engaging and disengaging the guide element with the guide track, and a rotary magnet for controlling wheel-steerage by means of its polarity determined by energizing the electromagnetic coil.

2 Claims, 2 Drawing Sheets

APPARATUS FOR TRANSFERRING A RUNNING TRACK OF A RACING TOY

FIELD OF THE INVENTION

This invention relates to an apparatus for transferring a running track of a racing toy on a running base provided with guide tracks.

BACKGROUND OF THE INVENTION

A racing toy which includes a single running base provided with a plurality of endless parallel guide tracks spaced apart at a predetermined distance from each other, on which one or more running bodies (for example, toy bodies) may run simultaneously is well known. The running body for use in such type of the racing toy is generally known to have a driving motor and a circuit for controlling the motor-drive. As a power-supplying system therefor, it is known to provide an electric path extending along the guide track on the base or a radio-controllable system containing a secondary battery.

In the conventional racing toy of such type, however, the power-supplying system of the electric path along the guide track does not allow the change of a running direction or the steering control independently for the running body in order to transfer one track to another adjacent track. On the other hand, the power-supplying system containing the secondary battery may utilize the radio-controllable system for conducting not only the drive-control, but also the steering-control. In the latter case, however, utilization of a slot as the guide track for inserting a protruding guide pin of the running body into the slot makes track-transfer impossible or extremely difficult with the radio-controllable system during the running phase.

Accordingly, an object of the invention is to provide an apparatus in a racing toy for transferring the racing toy car between parallel guide tracks, in which instructions from a radio-transmitter may readily and conveniently conduct the engagement and disengagement of the track with an engaging means of the toy car, as well as the steering-control, thereby enabling an optional track-transfer at any time of the running phase.

SUMMARY OF THE INVENTION

In order to achieve the above object, the invention provides an apparatus in a racing toy for transferring a running track of a racing toy car, in which a motor-driven running body runs on a base having a plurality of guide tracks in parallel, the body having a guide element engageable with the guide track, characterized in that the running body is provided with an electromagnetic coil for engaging and disengaging the guide element with the guide track, and further provided with a rotary magnet for controlling wheel-steerage by means of its polarity determined by energizing the electromagnetic coil.

In the apparatus according to the invention, the guide element engageable with the guide track may be a guide pin which protrudes from a front end of a movable iron core supported with a spring at one end of the electromagnetic coil.

Further, the rotary magnet may be fixed and swingably supported to a middle position of an axle of the front wheels of the car so as to have a different polarity in the axial direction, and yoke portions of the electromagnetic coil may be formed at either side perpendicular to the axle, thereby providing oppositely arranged electrodes having different polarity.

In the apparatus according to the invention, the electromagnetic coil is preferably energized to provide the opposite selected polarity by means of a radio-controllable system.

In accordance with the invention, the engagement and disengagement of the guide element with the track on the base may be achieved by use of the controlling circuit utilizing the radio-controllable system for energizing the electromagnetic coil, while the magnetic polarity generated by the electromagnetic coil may control the wheel-steerage, thereby readily selecting a desired track and optionally changing the track for running.

The invention will now be described in more detail for its preferred embodiments with reference to the accompanying drawings.

PREFERRED EMBODIMENTS OF THE INVENTION

Figure 1:
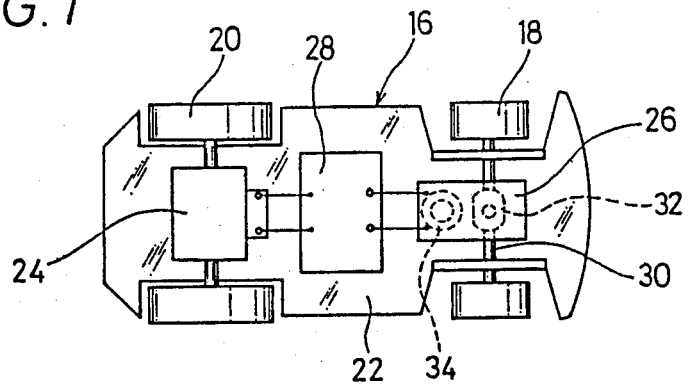
FIG. 1 is a schematic bottom view of one embodiment of the racing car useful in the apparatus according to the invention.
Figure 2:
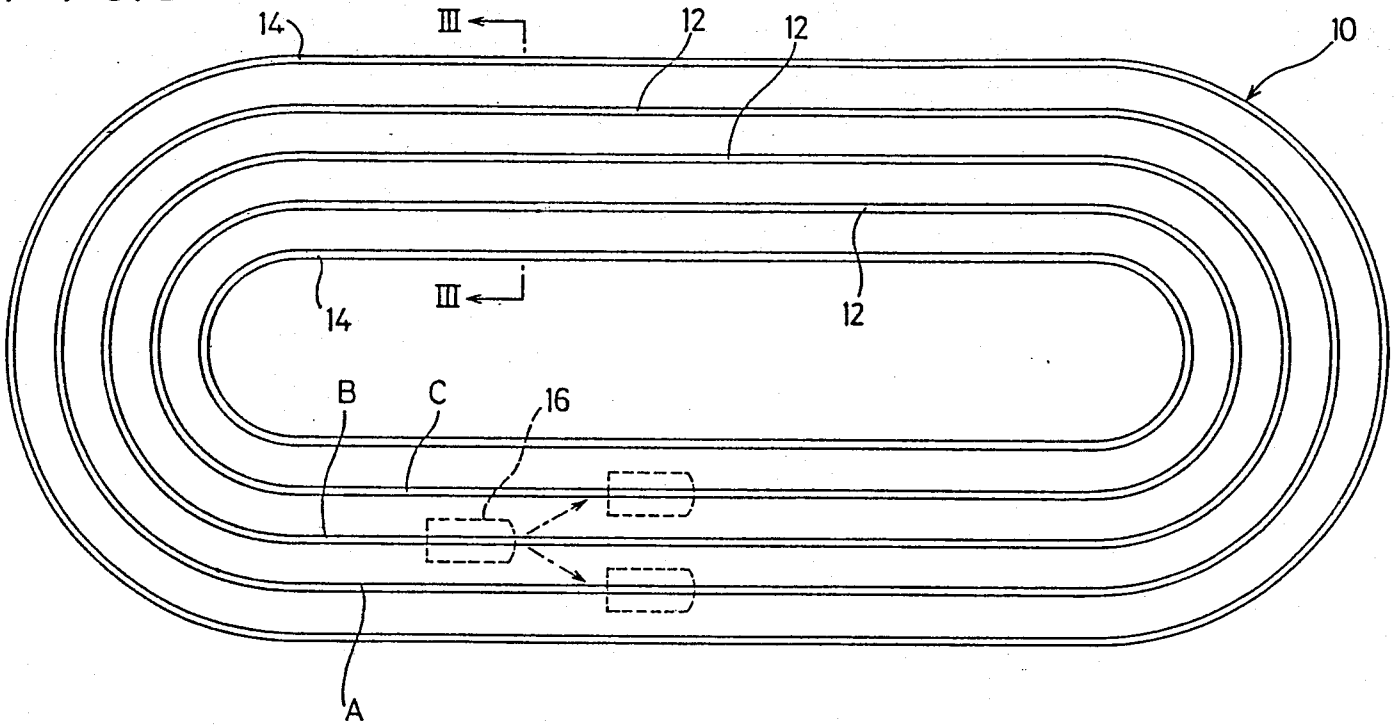
FIG. 2 is a plan view of the base for running the toy car of FIG.1.

FIG. 1 is a schematic bottom view of one embodiment of the racing car useful in the apparatus according to the invention, while FIG. 2 is a plan view of the base for running the toy car of FIG. 1.

Figure 3:
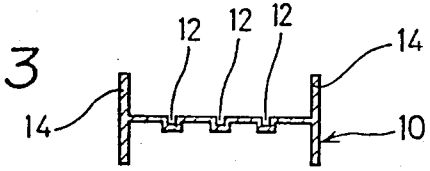
FIG. 3 is a sectional view of the base along the line III—III of FIG. 2.

In FIG. 2, the reference 10 represents a racing base which is provided thereon, as described hereinafter in detail, with a plurality of parallel endless slots 12 spaced apart at a predetermined distance from each other. Further, the base at its either edge is provided with a side wall 14 for preventing a running body (a toy car) 16 from going out of the track (see FIG. 3). The running body 16 having the apparatus for transferring the track according to the invention to be utilized for the racing base 10 includes a car body 22 having front and rear wheels 18 and 20, respectively, as shown in FIG. 1. Further, the car body 22 contains a motor 24 for driving the rear wheels 20, a track-transferring mechanism 26 and a circuit 28 for controlling these parts. The controlling circuit 28 is provided with a power battery and a radio-receiver (not shown) which generates operative instructions for conducting the drive-control of the motor 24 and the steering-control of the track-transferring mechanism 26. Circuit connections of the motor 24 to the rear wheels 20 and of the controlling circuit 28 thereto are conventional in the art of the radio-controlling system.

According to this embodiment, the track-transferring mechanism 26 comprises a rotary magnet 32 connected to a middle portion of an axle 30 of the front wheels 18, an electromagnetic coil 34 adjacent to the rotary magnet, and a movable guide pin 36 which is perpendicular to the axle 30 and vertically movable through energization of the electromagnetic coil 34. As shown in FIGS.

Figure 4:
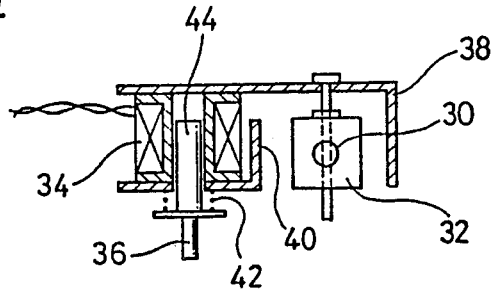
FIG. 4 is a sectional side view of main portions of a transferring mechanism in the toy car of FIG. 1.
Figure 5:
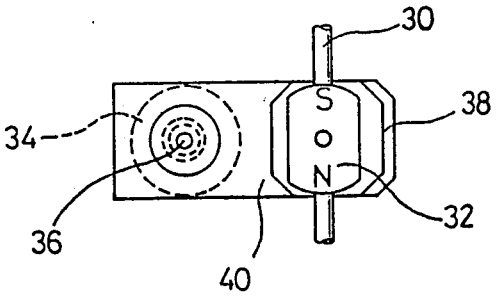
FIG. 5 is a bottom view of the transferring mechanism of FIG. 4.

4 and 5, the rotary magnet 32 is swingably supported to the axle 30 and positioned so as to provide different polarities at either end in the same orientation of the axle 30. Further, the rotary magnet 32 at its either end is provided with electrodes 38, 40 forming yoke portions which are connected to the different polarities of the electromagnetic coil 34 in the direction perpendicular to the axle 30. Into a hollow space of the electromagnetic coil 34 is inserted a movable iron core 44 which at its one end is provided with a spring 42, as best shown in FIG. 4. The iron core 44 at its front end is provided with the protruded guide pin 36. In the track-transferring mechanism 26 thus constructed, the electromagnetic coil 34 is electrically connected to the controlling circuit 28 and energized by the latter to attract the movable guide pin 36. At the same time the rotary magnet 32 may swing, depending on the polarity of the electromagnetic coil 34, to steer the front wheels 18 thereby achieving the track transfer on the racing base 10.

The operation of the apparatus according to the invention will be described below.

Referring to FIG. 2, the running body 16 is now running along the B slot 12. At any time of this running phase, the radio-transmitter is operated to generate an instruction for reducing a rotation rate of the motor 24 and hence of the rear wheels 20. When the running body comes to a straight course of the B slot 12, the radio-transmitter is again operated to generate another instruction for energizing the electromagnetic coil 34. In this case, the electromagnetic coil 34 may be energized so as to change its polarity to the electrodes 38 and 40, respectively. Now upon energization of the coil 34 in the one polarity relation, the moveable iron core 44 is attracted to the electromagnetic coil 34 against a force of the spring 42 and held in the hollow space thereby removing the guide pin 36 from the B slot 12, while at the same time the rotary magnet 32 swings in the direction corresponding to the polarities of the electrodes 38,40 (which polarities depend on the polarity of the electromagnetic coil 34) thereby transferring the slowly running car body 16 from the B slot toward the adjacent A or C slot. When the running body 16 has arrived at the intended position, the operational instruction of the radio-transmitter is then released to allow the guide pin 36 to restore its insertion into A or C slot with the action of the spring 42, thereby achieving the stable running operation on the A or B slot of the track (see FIG. 2).

It will be appreciated from the above embodiment that the guide pin of the running body may be engaged and disengaged with the track or the slot by the electromagnetic coil, while the rotary magnet may swing by the electrodes formed through the energization of the electromagnetic coil, thereby steering the front wheels. Thus, the conventional radio-control system for the toy racer may be employed to achieve the convenient and reliable track-transfer.

In particular, the apparatus according to the invention may be readily manufactured at a low cost by essentially using the electromagnetic coil and the permanent magnet, and enables the running toy car to change its track optionally to the left or the right, thereby providing a very interesting racing toy at a low cost.

What is claimed is:

1. In a toy racing car assembly wherein at least one toy running body including a steerable front axle and a motor driven rear axle is propelled about a base having a plurality of guide tracks arranged in parallel, the running body including a guide pin for engaging a guide track on the base and an electromagnetic coil energized by a steering control of the running body for displacing said guide pin to selectively engage and disengage the guide track, the improvement which comprises apparatus for transferring the running body to a different guide track, including (a) a movable iron core arranged within the electromagnet, a lower portion of said iron core comprising said guide pin which protrudes from said electromagnetic coil for engaging a track;

(b) spring means for normally biasing said guide pin downwardly toward its track-engaging position;

(c) yoke portions connected with said electromagnetic coil and arranged perpendicular to said front axle at either side thereof to define oppositely arranged electrodes having different polarity; and (d) a rotary, permanent magnet connected with the front axle at the middle portion thereof, said magnet being rotatably supported having an axis defined by its' north and south poles, said axis being parallel to the axle of said front axle, said magnet interacting with said electromagnet to control the steering of the running body in accordance with its polarity as determined by the electromagnetic coil yokes.

2. Apparatus as defined in claim 1, and further comprising radio control means for energizing the electromagnetic coil to provide the opposite selected polarity for displacing the guide pin and for steering the front axle to transfer the running body to another track.

* * * * *